US005731987A

United States Patent [19]

Strong et al.

[11] Patent Number: 5,731,987

[45] Date of Patent: Mar. 24, 1998

[54] TELESCOPIC BOOMS

[75] Inventors: John Strong; Peter Clark, both of Sunderland; Nigel Harrison, Washington; Christopher Watson, Hebburn, all of Great Britain

[73] Assignee: Kidde Industries, Inc., Iselin, N.J.

[21] Appl. No.: 666,369

[22] PCT Filed: Dec. 22, 1994

[86] PCT No.: PCT/GB94/02790

§ 371 Date: Jun. 20, 1996

§ 102(e) Date: Jun. 20, 1996

[87] PCT Pub. No.: WO95/17343

PCT Pub. Date: Jun. 29, 1995

[30] Foreign Application Priority Data

Dec. 23, 1993 [GB] United Kingdom ..... 9326347

[51] Int. Cl.[6] ..... B66C 23/00

[52] U.S. Cl. ..... 364/505; 364/506; 364/424.07; 212/347; 212/348; 212/350

[58] Field of Search ..... 364/505, 424.07, 364/506; 212/150, 270, 230, 278, 233, 175, 347, 348, 350, 264, 223, 292

[56] References Cited

U.S. PATENT DOCUMENTS

| | | | |
|---|---|---|---|
| Re. 30,905 | 4/1982 | Lester et al. | 52/115 |
| 3,807,108 | 4/1974 | Johnston | 52/115 |
| 3,819,922 | 6/1974 | Horn et al. | 364/424.07 |
| 3,870,160 | 3/1975 | Hutchings | 212/39 R |
| 4,156,331 | 5/1979 | Lester et al. | 52/115 |
| 4,178,591 | 12/1979 | Geppert | 340/385 |
| 4,205,308 | 5/1980 | Haley et al. | 340/686 |
| 4,456,093 | 6/1984 | Finley et al. | 182/2 |
| 4,468,166 | 8/1984 | Jameson | 414/390 |
| 4,906,981 | 3/1990 | Nield | 340/685 |
| 5,058,752 | 10/1991 | Wacht et al. | 212/150 |

FOREIGN PATENT DOCUMENTS

| | | |
|---|---|---|
| 0063709 | 11/1982 | European Pat. Off. . |
| 643010 | 9/1950 | United Kingdom . |
| 1361832 | 7/1974 | United Kingdom . |
| 1402602 | 8/1975 | United Kingdom . |
| 1406337 | 9/1975 | United Kingdom . |
| 0072137 | 9/1981 | United Kingdom . |

*Primary Examiner*—James P. Trammell
*Assistant Examiner*—Demetra R. Smith

[57] ABSTRACT

An operating system for telescoping a telescopic boom for a crane, particularly a boom having three or more telescoping sections, enabling the boom to be extended and retracted automatically under load according to a predetermined sequence which optimises the load capacity of the boom and the stability of the crane. The boom may be switched rapidly between modes of operation in one of which all of the telescoping sections may extend or retract and in another of which at least one telescoping section is maintained in the fully retracted position.

23 Claims, 6 Drawing Sheets

2
4
6
8
10
12
14
16

TELESCOPIC BOOMS

BACKGROUND OF THE INVENTION

1. Field of the Invention

This invention relates to an operating system for the telescopic movement of a telescopic boom for a crane, particularly a boom having one non-telescopically moveable section and three or more telescoping sections.

2. Description of Related Art

In conventional telescopic booms having multiple telescoping sections the extension and retraction of the boom is normally controlled by the operator using multiple control switches, or levers, each of which controls the extension and retraction of one, or possibly two, telescoping sections. With such an arrangement, when the boom is under load, there is a significant risk that the operator might inadvertently exceed the load capacity of the boom. There is also a risk that the operator might telescope the boom into a configuration which renders the boom and the structure to which the boom is mounted, such as a vehicle, for example, unstable, whether by over-extending the boom or by telescoping the boom sections into an inappropriate configuration for a particular overall boom length.

For these reasons, when it is necessary to extend or retract a multiple section boom in order, for example, to vary the reach of a crane, it may be necessary to do this when the boom is not under load.

U.S. Pat. No. 4,589,076 discloses a method of operating a telescopic boom so as to switch the telescopic movement between successive boom sections with accurate timing and so as to account for errors in the measurement of the overall boom length.

In order to optimise the lifting capacity of the crane, it is common to operate a multiple section telescopic boom in two modes of operation. The first mode of operation is with at least one of the innermost telescoping boom sections held in the fully retracted position, hereinafter referred to as the first mode of operation of the boom. The second mode of operation is by extending or retracting all of the telescoping sections in a prescribed manner, hereinafter referred to as the second mode of operation. In order to switch between the first and second modes it is first necessary with conventional boom operating systems fully to retract the boom, and this can be a lengthy procedure.

SUMMARY OF THE INVENTION

It is an object of the present invention to facilitate the telescoping of a crane boom having a plurality of telescoping sections whilst optimising the load capacity of the boom and/or the stability of the crane for any given overall boom length.

It is a further object of the present invention to provide an operating system for a multiple section telescopic boom which minimises the time required to switch between the first and second modes of operation.

A further object of the invention is to reduce the time taken to change the overall length of the boom.

A still further object of the present invention is to simplify the procedure to be undertaken by an operator in order to change the overall boom length.

A method of operating the telescopic boom of a crane in accordance with the invention comprises calculating, for each of a number of overall boom-lengths, the lengths of extension of the respective boom sections which optimise the load capacity and/or the stability of the crane when the boom is under load at the said overall boom lengths, and programming the calculated boom section extension lengths into processing means which, in response to a signal input by an operator to extend or retract the boom between two operating boom lengths, determine the optimum sequence of movements of the respective sections as the boom length increases/decreases so that at any boom length intermediate two said overall boom lengths the load capacity and/or the stability of the crane is/are optimised and produce corresponding output signals to means for moving the respective sections.

With such an arrangement an operator may telescope the boom from the fully retracted position to the fully extended position or to any intermediate position or vice versa, in a predetermined and safe sequence, in a fully automatic manner and using only a single control. Because the boom sections automatically telescope through a sequence of predetermined and safe section positions or extensions, the boom may be telescoped under load.

The method may comprise the operator inputting operating signals into processing means in order to telescope the boom from a first operating boom length to a second desired operating boom length, measuring the instantaneous overall boom length and the processing means outputting a signal corresponding to the measured boom length to means for displaying the measured boom length, and ceasing to input operating signals when the displayed boom length is the same as the desired operating boom length. The operator may monitor the display means or simply observe the boom to determine when the boom has reached the desired operating length.

Preferably the operator inputs operating signals via a single control which is switchable between a position in which the input signal is effective to extend the boom, a position in which the input signal is effective to retract the boom, and an intermediate neutral position in which no input signal is generated.

In accordance with the invention, an operating system for the extension or retraction of a telescopic boom for a crane between two operating boom lengths, the boom having at least three telescoping sections, comprises means for inputting signals so as to extend or retract the boom, processing means programmed with the lengths of extension of the respective boom sections which have been calculated, for each of the number of overall boom lengths, to optimise the load capacity and/or the stability of the crane when the boom is under load, the processing means being adapted, in response to the input signals, to determine the optimum sequence of movements of respective boom sections as the boom length increases/decreases so that at any boom length intermediate the two operating boom lengths the load capacity and/or the stability of the crane is/are optimised and to produce output signals to means for extending and retracting the respective boom sections.

Preferably means are provided to sense the load and the overall boom length, the processing means being adapted to halt the telescoping of the boom should the load exceed the safe working load of the boom at any overall boom length, or should the positions of the respective boom sections render the structure to which the boom is mounted unstable at a particular overall boom length.

As explained above, it is known to operate multiple section telescopic booms with one or more of the innermost telescoping sections held in the fully retracted position.

For clarification the terms "inner" and "outer" are employed herein with reference to the structure supporting the boom. Thus the innermost boom section is that section closest to the support structure (and furthest from the load) and the outermost boom section (commonly referred to as the 'fly' section) is that furthest from the support structure (and closest to the load). The innermost telescoping member is, however, the telescopically moveable boom section closest to the support structure and not the innermost boom section, which is normally not moveable telescopically. Where used herein, the terms "inner", "innermost", "outer" and "outermost" should be construed accordingly.

To facilitate the operation of a telescopic boom comprising at least three telescoping sections in such a manner, the processing means may be programmed automatically to extend or retract the boom under load according to a first mode in which at least one innermost telescoping section is maintained in the fully retracted position, or according to a second mode in which all of the sections may be telescoped in or out as set out above to optimise the load capacity of the boom.

In order to switch from the first mode to the second mode, or vice versa, means may be provided to extend or retract the boom under manual control, and to extend or retract the at least one innermost telescoping boom section under manual control to identify the nearest position in the instant mode in which, with the exception of the innermost section, the boom section positions substantially coincide with those of the other, desired mode, the processing means being actuated so as to enable telescoping of the boom in the other, desired mode. Means are preferably provided to telescope the innermost section independently of the other section(s) for this purpose.

With such an arrangement the boom may be switched rapidly between modes of operation, in one of which all of the telescoping sections may extend or retract and in the other of which at least one of the innermost telescoping sections is maintained in the fully retracted position, without first having fully to retract all of the sections, which might take several minutes in the case of a typical 49 meter long, 5 section boom.

The processing means may comprise means for sensing the overall boom length and means for sensing the extension of at least the first, or innermost, telescoping section, the control means being adapted to prevent further telescoping of the boom if an error arises in the sensed section extensions of more than a predetermined amount.

Preferably the processing means prevents further telescoping of the boom should an error in the extension of any section occur of more than a predetermined percentage such as 3%, for example. Should such an error occur, means are provided for an operator to telescope the appropriate section (s) manually so as to correct the error; once the error has been corrected automatic telescoping of the boom in the predetermined sequence can be resumed. Display means may be provided to indicate to the operator the extension of each telescoping section to assist in this process.

BRIEF DESCRIPTION OF THE DRAWINGS

The invention will now be described by way of example and with reference to the accompanying drawings, in which.

DETAILED DESCRIPTION OF THE PREFERRED EMBODIMENTS

Figures 3A, 3B, 3C, 3D, 3E, 3F, 3G, 3H, 3I:
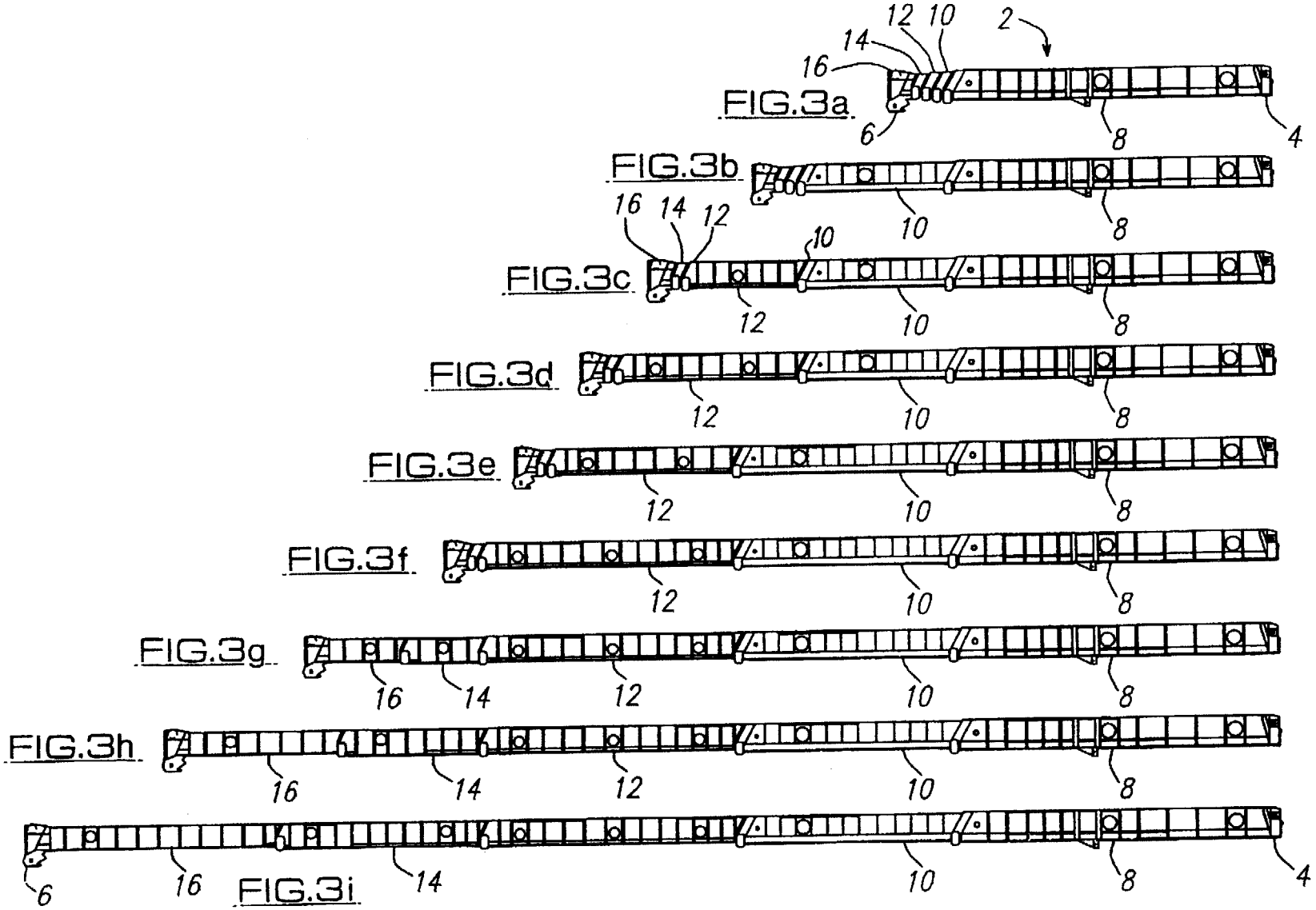
FIGS. 3*a* to 3*i* show the extension sequence of the boom shown in FIGS. 2*a* to 2*d* in another mode of operation in which all of the telescoping sections are free to telescope.
Figures 4A, 4B, 4C, 4D, 4E:
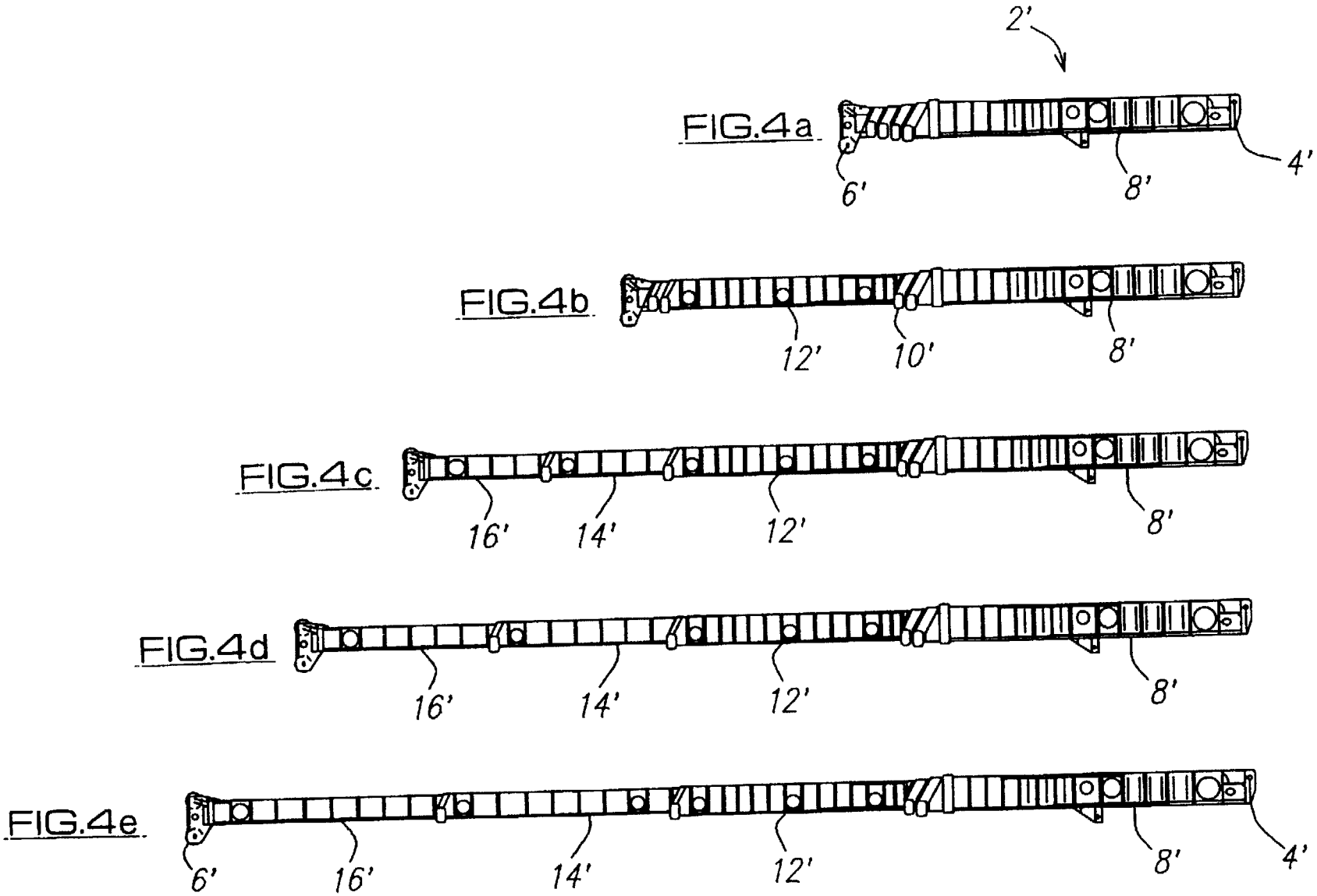
FIGS. 4*a* to 4*e* show the extension sequence of another 5-section boom in a mode of operation in which the inner-mid telescoping section is maintained in the fully retracted position.
Figures 5A, 5B, 5C, 5D, 5E, 5F, 5G, 5H, 5I, 5J:
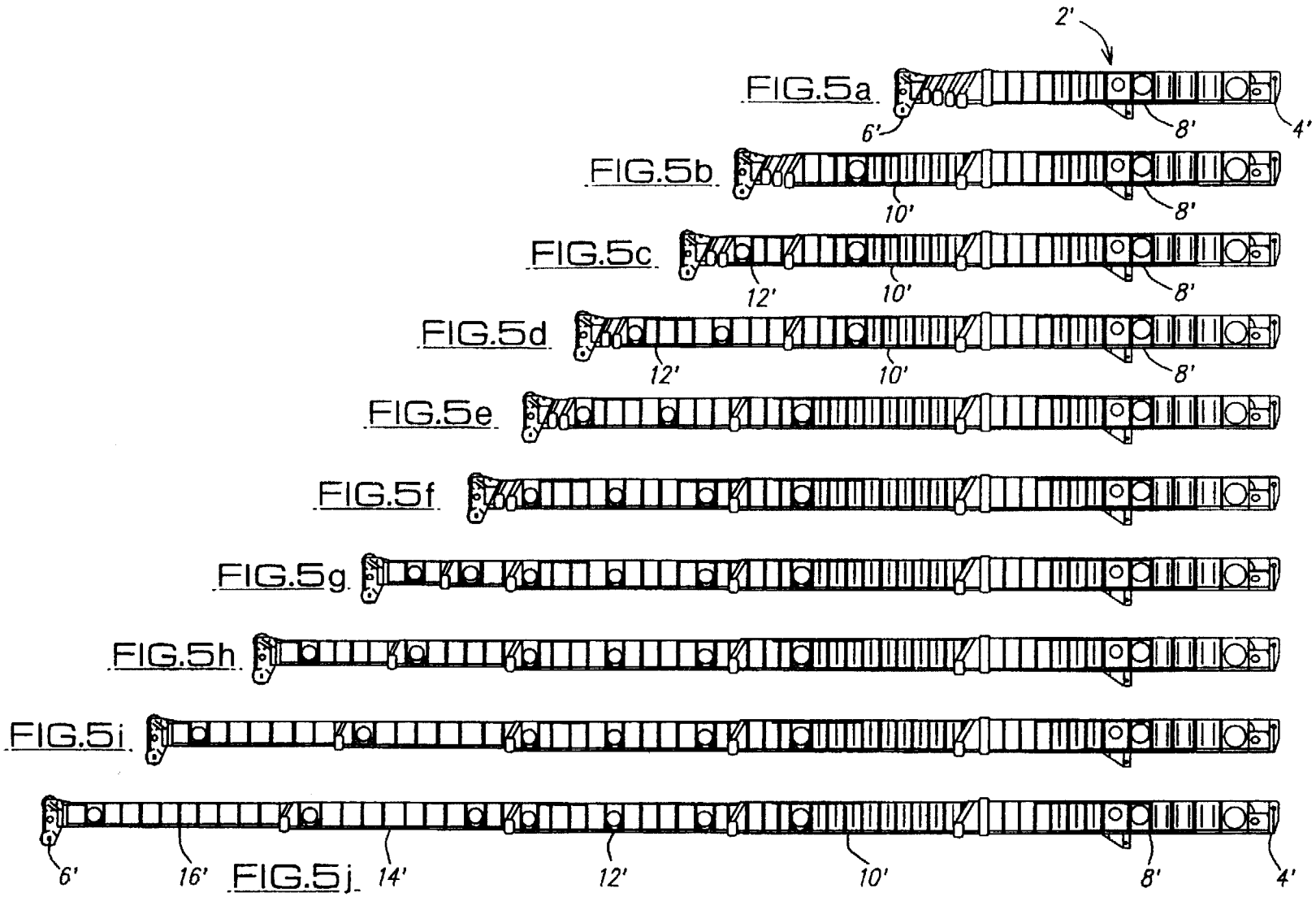
FIGS. 5*a* to 5*j* show the extension sequence of the boom shown in FIGS. 4*a* to 4*e* in another mode of operation in which all of the telescoping sections are free to telescope.

Referring to the Figures generally, a system in accordance with the invention is described in relation to a telescopic boom having 5 sections, that is, a boom having 4 telescoping sections (as shown clearly in FIGS. 3 and 5). FIGS. 2 and 3 illustrate one boom and figures 4 and 5 illustrate a second boom; FIGS. 2 and 4 illustrate the extension sequences of the two booms in a mode of operation in which the inner-mid telescoping section is maintained in the fully retraced position, whilst FIGS. 3 and 5 illustrate the respective extension sequences in another mode of operation in which all of the boom sections are free to telescope. Elements of the second boom shown in FIGS. 4 and 5 which are equivalent to elements of the first boom shown in FIGS. 2 and 3 are denoted by the same reference numerals as the former, but with the addition of a dash, or prime.

Figure 1:
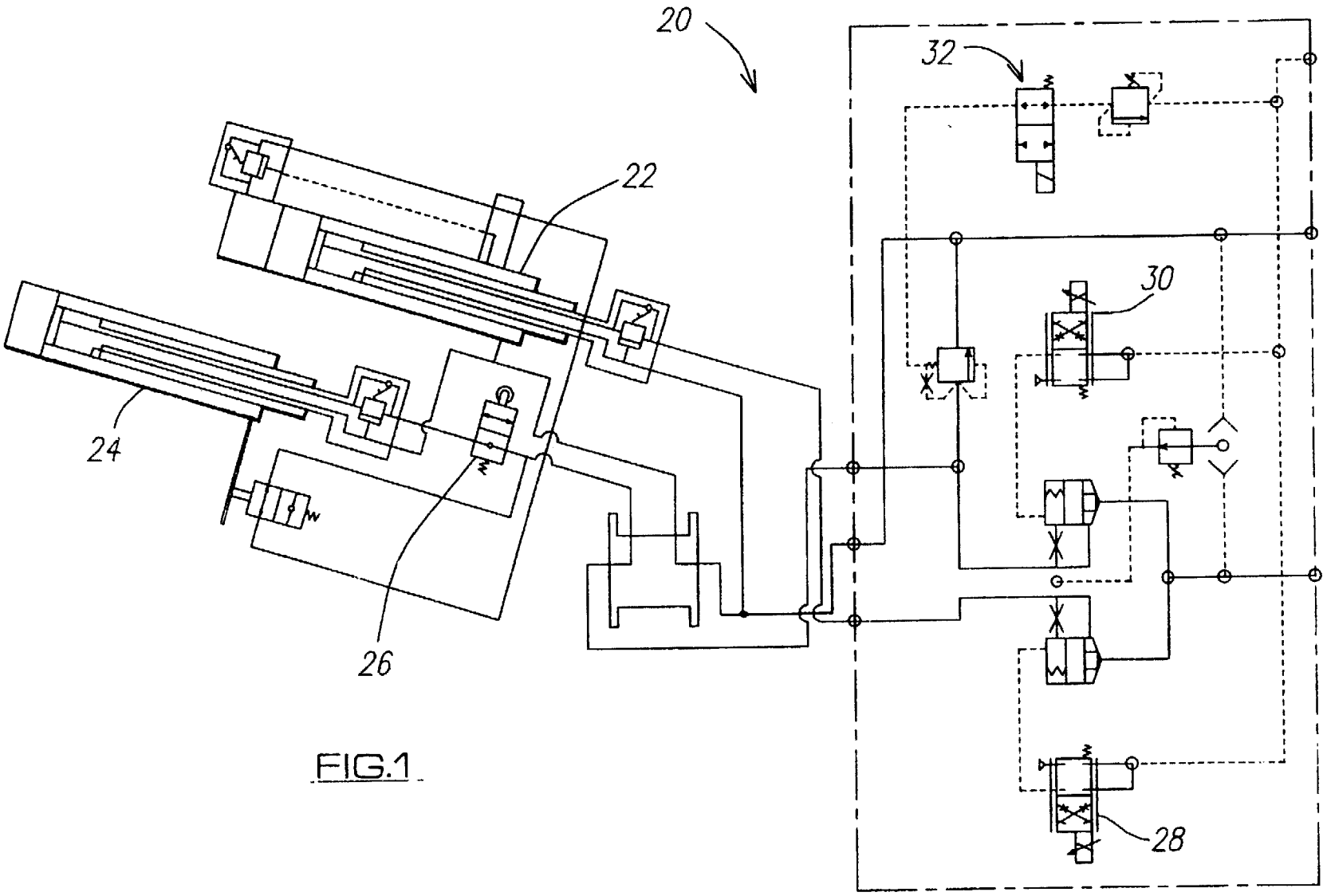
FIG. 1 is a schematic diagram showing a hydraulic portion of an operating system in accordance with the invention for telescoping a 5-section boom.

FIG. 1 shows a hydraulic portion 20 of an operating system in accordance with the invention for the telescoping of a 5-section telescopic boom, such as those shown in FIGS. 2 to 5, for example. The system 20 operates a two-stage telescopic cylinder 22, which extends and retracts the inner-mid 10,10' and the mid 12,12' telescoping sections, and a second single stage telescopic cylinder 24 which extends and retracts the outer-mid telescoping section 14,14' and, by means of a conventional cable system (not shown), the fly, or outermost, telescoping section 16,16'. The cable system is so configured as to ensure that the outer-mid 14,14' and fly 16,16' sections are synchronised so that they extend and retract substantially simultaneously.

As in conventional telescoping boom operating systems there is a boom load sensor (not shown) to sense the load on the boom, a pendulum angle sensor (not shown) to sense the angle of elevation of the boom, a pressure transducer (not shown) to sense the instantaneous pressure in the hydraulic system and a potentiometer 54 (see FIG. 1*a*) to measure the overall boom length. These measurements are input to a central processing unit 42 described further below which compares the measured values with a set of values which have been calculated so as to ensure the safe operation of the crane. Should the comparison indicate that the crane is approaching an unsafe position, for example, the moment determined by the product of the load and the overall boom length is such that the crane is approaching a position which is unstable, and the crane might overbalance, then this fact is brought to the attention of the operator. A safe load indicator (not shown) is provided for this purpose and this may be graduated with green, amber or red zones to indicate safe, approaching unsafe and unsafe operation of the crane respectively.

The hydraulic system 20 is in turn operated by a central processing unit (cpu) 42 comprising a suitable microprocessor 40 (see FIG. 1*a*) to extend and retract the boom in one of two modes of operation. In a first mode, shown in FIGS. 2 and 4, the boom 2,2' is effectively a 4-section sequenced/synchronised telescopic boom in which the inner-mid section 10,10' is maintained in the fully retracted position. On extending the boom 2,2' the mid section 12,12' extends first via cylinder 22 and at full extension of the mid section 12,12' a cam (not shown) actuates a changeover valve 26 (see FIG. 1) inside the boom which then changes flow to the outer-mid section 14,14' telescoping cylinder 24. The outer-mid 14,14' and fly 16,16' sections then extend substantially simultaneously synchronised by the cylinder 24 and a cable system (not shown). The inner section 8,8' of the boom is fixed at the inner end 4,4' of the boom in a conventional manner, so as to be able to elevate and/or slew the boom, and any load is carried at the outermost end 6,6' of the boom. The retraction sequence of the boom in the first mode is the reverse of the extension sequence described above.

In the second mode, as shown in FIGS. 3 and 5, the boom 2,2' operates as a 5-section sequenced/synchronised boom. On extending the boom 2,2' the inner-mid 10,10' and mid 12,12' sections extend in a predetermined sequence by means of a two stage cylinder 22 until they are fully extended. The cam then actuates the changeover valve 26 so as to change the flow of hydraulic fluid to the outer-mid section 14,14' telescoping cylinder 24. The outer-mid 14,14' and fly 16,16' sections then extend substantially simultaneously, synchronised by the cylinder 24 and a cable system as is well known in the art. The retraction sequence in the second mode is the reverse of the extension sequence described above.

The microprocessor 40 is programmed to extend and retract the boom sections so as to optimise the load capacity of the boom at a number of overall boom lengths and to optimise the stability of the crane to which the boom is mounted throughout the extension or retraction of the boom.

Figure 1A:
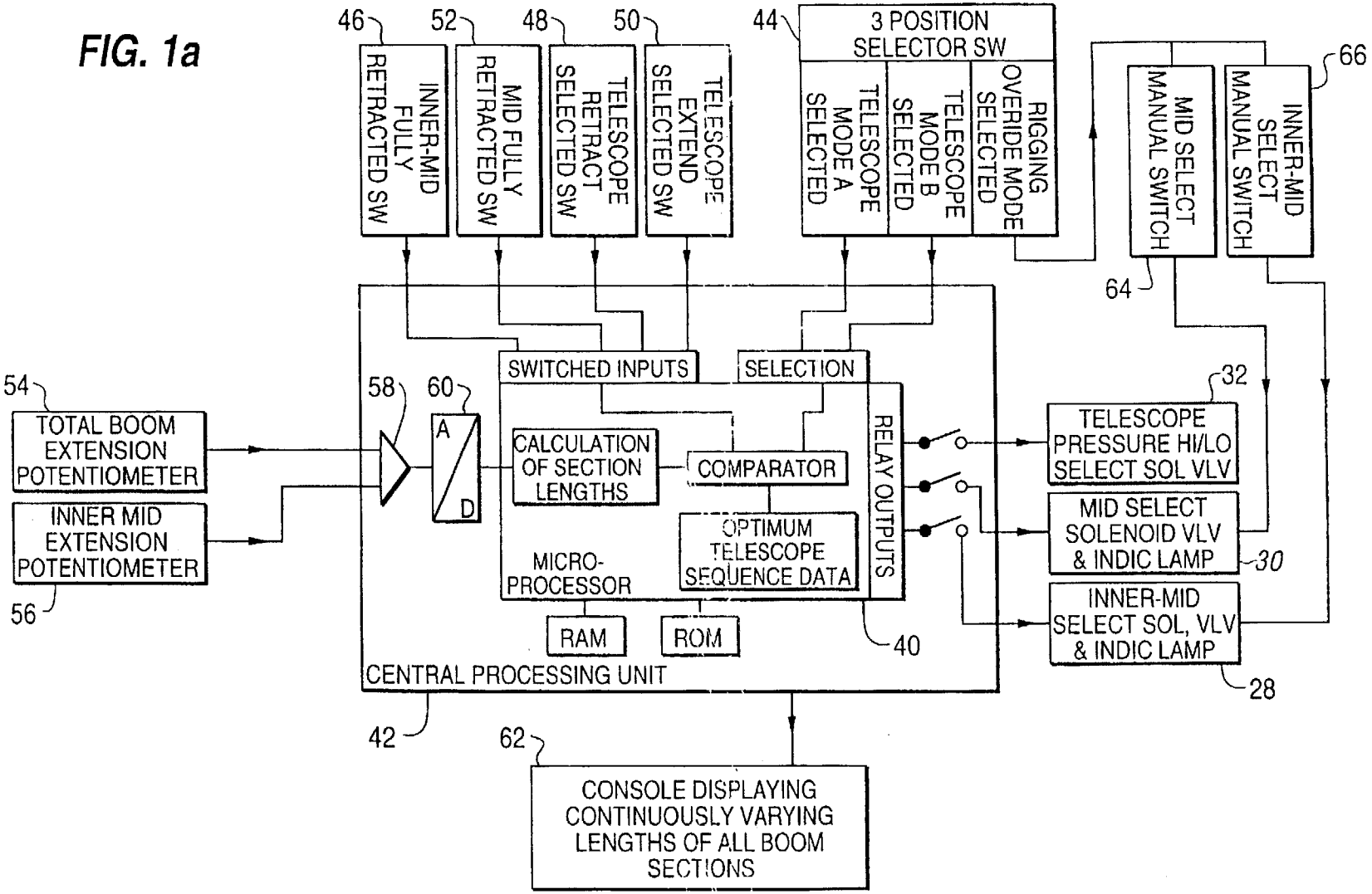
FIG. 1*a* is a logic block diagram of an electronic portion of an operating system in accordance with the invention showing a central processing unit incorporating a microprocessor for operating the hydraulic system of FIG. 1.
Figure 2A:
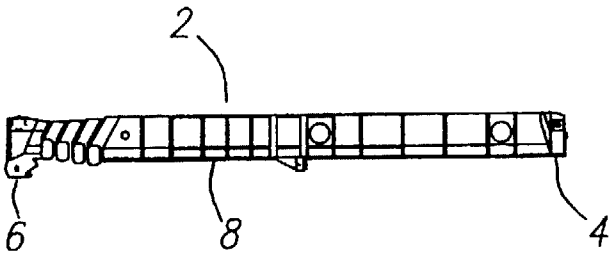
FIGS. 2*a* to 2*d* show the typical extension sequence of a 5-section boom in a mode of operation in which the inner-mid telescoping section is maintained in the fully retracted position.
Figure 2B:
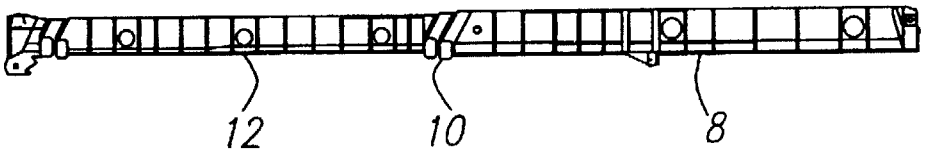
Figure 2C:
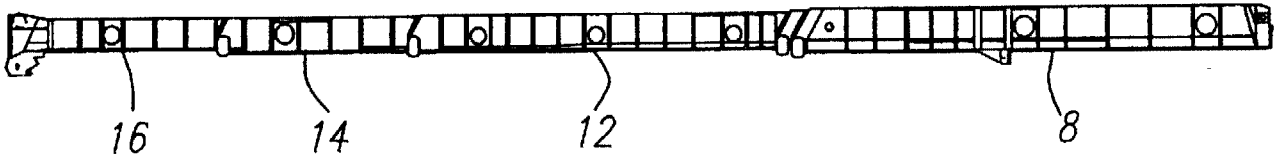
Figure 2D:
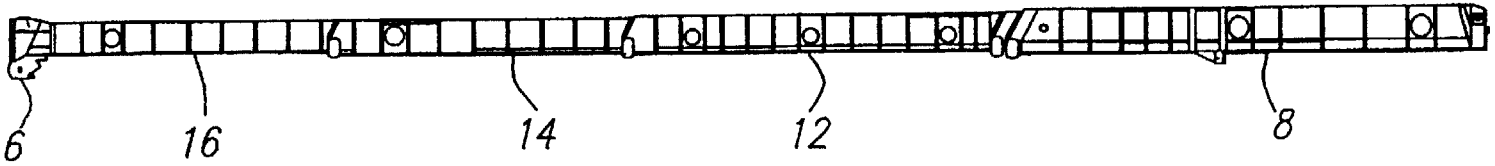

Referring now to FIG. 1*a*, the microprocessor 40 has four switched inputs, namely one according to whether the first or second mode has been selected on a mode selection switch 44, one from a proximity switch 46 which indicates that the inner-mid section 10,10' is fully retracted, one from a switch 48, if the boom is to be retracted, or telescoped in, or from a switch 50, if the boom is to be extended, or telescoped out, and one from a proximity switch 52 which indicates that the mid section 12,12' is fully retracted. The proximity switch 46 functions to check that when the boom is fully retracted, the extension length of each section displayed on a console 62 is approximately zero, otherwise an error signal is displayed. The function of the proximity switch 52 is to ensure that the mid section 12,12' is fully retracted before the inner-mid section 10,10' is allowed to retract. The telescope in and out switches 48,50 are present to overcome the situation where the boom has temporarily ceased telescoping at a changeover position, i.e. a position where one boom section ceases telescoping and a second boom section commences telescoping, particularly when the system is ramping up and down, as described below. If the telescope in switch 48 is operated, the system functions to telescope the inner-mid boom section, and if the telescope out switch 50 is operated the mid boom section telescopes.

There are also two analogue inputs to the cpu 42, one from a potentiometer 54 which produces an analogue signal according to the overall boom length and one from a potentiometer 56 which produces an analogue signal according to the extension of the inner-mid boom section. It should be realised that conventional potentiometers are only accurate to within ±30 cm and therefore cannot be relied on to ensure that sections are completely closed, hence the proximity switches 46, 52. These analogue signals are fed through an amplifier 58 and an analogue to digital converter 60 and thence into the microprocessor 40. It should also be realised that two potentiometers are required in a system for telescoping a five-section boom, but that further potentiometer(s) will be required for booms having more than five sections.

The microprocessor 40 has three switched output signals, namely one to power an inner-mid select solenoid valve 28 and an associated indicator light, a second to power a mid/outer mid and fly select solenoid valve 30 and an associated indicator light and a third to energise a high/low pressure solenoid valve 32. There is also an output signal from the microprocessor 40 to the console 62 for displaying the length by which each of the telescoping boom sections is extended.

The mode selection switch 44 is in the form of a three-way selector switch; the selector switch 44 being operative either to input a signal to the microprocessor 40 according to whether the first or second mode has been selected or, in the event that an operator has moved the selector switch 44 to a rigging, or manual override, position, it is operative to actuate two manual bypass switches 64,66 whereby the operator may actuate the telescopic cylinders 24, 22 via the mid solenoid valve 30 and inner-mid solenoid valve 28 respectively, in order to extend or retract the boom manually as required when switching between modes or to correct an error, for example.

The system illustrated in FIGS. 1 and 1*a* has a ramping system, which is effective to eliminate judder as the solenoids operate, and which operates as follows. At a predetermined position the microprocessor 40 ramps the signal to solenoid valve 28 down so that the inner-mid section 10,10' stops at a predetermined extension length. At this point the signal from the microprocessor 40 to the solenoid valve 32 is switched off, so as to de-energise solenoid valve 32. Then the ramp up of solenoid valve 30 commences. As the mid section 12,12' approaches a predetermined extension length the above process is reversed. Solenoid valve 30 is ramped down so that the mid section 12,12' stops at the predetermined extension length, and a signal from the microprocessor 40 energises solenoid valve 32 and ramp up of solenoid valve 28 commences. A further changeover as above occurs when the inner-mid section 10,10' approaches the fully extended position. When the mid-section 12,12' reaches full extension the changeover valve 26 changes hydraulic flow to the outer-mid telescoping cylinder 24 and the outer-mid 14,14' and fly 16,16' sections extend, synchronised by cylinder 24 and a cable system (not shown). This ramping system, prevents judder by causing the boom sections to start and stop telescoping gradually; it has been found that the ramps may be made very steep without any judder occurring, to the extent that the ramping system may not be essential.

After the outer-mid section 14,14' has extended a preprogrammed length (approximately 0.5 meters) the microprocessor 40 energises high pressure solenoid valve 32. The purpose of the high pressure solenoid valve 32 is to protect the two-stage telescoping cylinder 22 against buckling pressure. The mid 12,12' and inner mid 10,10' sections are powered by a two-stage telescoping cylinder 22 where the second-stage piston rod forms the first-stage cylinder. The second-stage cylinder is therefore much larger in diameter than the first and can exert a much higher load for a given pressure, hence the requirement to reduce the hydraulic pressure. The microprocessor 40 is programmed to ensure that the mid-section cylinder is fully extended before the final pressure change occurs.

The overall boom length and the length by which the inner-mid section 10,10' is extended are measured by means of potentiometers 54,56 and these length measurements are also input to the microprocessor 40 as described above. The microprocessor 40 is programmed to prevent further telescoping of the boom should a discrepancy of more than a certain amount arise between the measured lengths of extension of the sections and the calculated lengths of boom extension of the sections at any point. Such an error may occur due to the cable stretching, in which case instead of the overall measured boom length being zero in the fully retracted position a negative boom length is measured. The amount of discrepancy may be 3%, for example. In the event that such a discrepancy or error occurs, an error signal is generated and the operator must switch the three-way selector switch 44 to the rigging position, i.e. to manual override. The operator then telescopes the appropriate section(s) manually using the selector switches 64,66 so as to correct the discrepancy. Once the discrepancy has been corrected the appropriate telescoping mode can be selected on the selector switch 44 and the telescoping operation resumed. To assist in this process a display console 62 is provided to indicate to the operator the length by which each section is extended.

As described above the telescoping sequence for the boom is calculated so as to optimise the load capacity of the boom and to optimise the stability of the crane to which the boom is mounted and this sequence of optimum telescope data is programmed into the microprocessor 40. FIGS. 2 and 3 show the extension sequence of a first 5-section telescoping boom in the first and second modes of operation respectively and FIGS. 4 and 5 show the extension sequence of a second 5-section telescopic boom in the first and second modes of operation respectively. The overall-boom lengths and percentage extensions of each telescoping section for each boom configuration shown in FIGS. 2 to 5 are reproduced at Table 1.

TABLE 1

| | Overall Boom | Percentage Extension of each Section | | | |
|---|---|---|---|---|---|
| FIG. | Length (m) | Inner-Mid | Mid | Outer-mid | Fly |
| | | (10) | (12) | (14) | (16) |
| 2a | 12.07 | 0 | 0 | 0 | 0 |
| 2b | 20.30 | 0 | 100 | 0 | 0 |
| 2c | 28.53 | 0 | 100 | 50 | 50 |
| 2d | 24.02 | 0 | 100 | 83 | 83 |
| 3a | 12.07 | 0 | 0 | 0 | 0 |
| 3b | 17.55 | 67 | 0 | 0 | 0 |
| 3c | 20.30 | 67 | 33 | 0 | 0 |
| 3d | 23.04 | 67 | 67 | 0 | 0 |
| 3e | 25.79 | 100 | 67 | 0 | 0 |
| 3f | 28.53 | 100 | 100 | 0 | 0 |
| 3g | 34.02 | 100 | 100 | 33 | 33 |
| 3h | 39.51 | 100 | 100 | 67 | 67 |
| 3i | 45.00 | 100 | 100 | 100 | 100 |
| | | (10') | (12') | (14') | (16') |
| 4a | 12.96 | 0 | 0 | 0 | 0 |
| 4b | 21.90 | 0 | 100 | 0 | 0 |
| 4c | 30.84 | 0 | 100 | 50 | 50 |
| 4d | 35.31 | 0 | 100 | 75 | 75 |
| 4e | 39.78 | 0 | 100 | 100 | 100 |
| 5a | 12.96 | 0 | 0 | 0 | 0 |
| 5b | 19.67 | 75 | 0 | 0 | 0 |

TABLE 1-continued

| | Overall Boom | Percentage Extension of each Section | | | |
|---|---|---|---|---|---|
| FIG. | Length (m) | Inner-Mid | Mid | Outer-mid | Fly |
| 5c | 21.90 | 75 | 25 | 0 | 0 |
| 5d | 26.37 | 75 | 75 | 0 | 0 |
| 5e | 28.60 | 100 | 75 | 0 | 0 |
| 5f | 30.84 | 100 | 100 | 0 | 0 |
| 5g | 35.31 | 100 | 100 | 25 | 25 |
| 5h | 39.78 | 100 | 100 | 50 | 50 |
| 5i | 44.25 | 100 | 100 | 75 | 75 |
| 5j | 48.72 | 100 | 100 | 100 | 100 |

The system described above enables the boom 2,2' to be telescoped from fully retracted to fully extended or to any intermediate position and vice versa, whilst under load, in a predetermined sequence through the operation of one single control lever and in a fully automatic manner. The amounts by which each telescoping section are to be extended at a number of overall boom lengths are calculated so as to optimise the load capacity of the boom and the stability of the structure to which the boom is mounted, such as a crane vehicle, for example. The boom is then extended or retracted in a predetermined sequence between these configurations automatically.

Because the system telescopes the boom automatically in an optimum predetermined sequence it is possible to attempt to telescope any load, within the limitations of the crane capacity chart, at any telescoped position within either of the two modes. The system "fails safe", indicating that the boom has moved into a position which renders the crane unsafe, whether by exceeding the load capacity or by rendering the crane unstable, and by stopping the telescoping motion should the boom telescope outside of the predetermined sequence. In order to telescope the boom the operator has only to operate a single control to either extend or retract the boom.

The system limits the hydraulic pressure throughout the telescoping operation, to protect the telescoping cylinder 22 and a ramping system may be used to provide smooth changeover as one section ceases telescoping and the telescoping motion is taken up by another section.

The system allows a change to be made from the first mode to the second mode or vice versa at any telescoped position, without load, by means of a rigging switch 44. When changing modes with the boom partly telescoped then the rigging position is selected. The term 'rigging' in this context refers to telescoping the boom outside of a predetermined sequence and without load.

The method of changing mode is firstly to relieve any load on the boom, then to select the rigging position, that is a position in which, with the exception of the position of the inner-mid telescoping section 10,10' the respective positions of the boom sections are common to both the first and second mode. The rigging positions may be programmed into the system, and the operator may be provided with a chart indicating these. The operator moves the switch 44 into the rigging position whilst watching the display console 62. The operator then selects either the mid or inner-mid telescopic cylinder 22,24 and then operates the main crane telescoping control to either telescope in or out the appropriate sections. The operator monitors a boom length display 62 carefully until the boom is telescoped into one of the length combinations acceptable in the desired mode and the system is then switched from the rigging position to the first or second modes as appropriate and the load can be picked up again. The boom will then telescope automatically in the predetermined sequence of that mode. This avoids having to fully retract the telescopic boom in order to change, mode, as this could take several minutes on a long boom, such as those shown in FIGS. 2 to 5.

The control system in accordance with the invention is described above in relation to a 5-section telescopic boom but the principle can easily be applied to booms with a greater or lesser number of sections and with individual or multiple-stage telescoping cylinders and/or cables. It will be appreciated, however, that to adapt the system of the present invention to operate a telescopic boom having more than 5 sections then it would be necessary to, employ further potentiometer(s), input switch(es) and solenoid valve(s), and to adapt the microprocessor, in order to accommodate more than the five sections which the illustrated embodiment of the invention is adapted to operate.

We claim:

1. A method for controlling a telescopic boom having at least three boom sections, comprising:

(a) storing at least one boom extension table, said boom extension table including a plurality of telescopic boom lengths and, for each telescopic boom length, a section length corresponding to each boom section;

(b) inputting one of retraction and extension control signals from an operator;

(c) determining a sequence of boom section movements based on said boom extension table and said input control signal; and (d) controlling movement of said boom sections in accordance with said sequence of boom section movements.

2. The method of claim 1, wherein said step (a) stores section lengths corresponding to each of said telescopic boom lengths which optimize at least one of load capacity and stability of a crane including said telescopic boom; and said step (c) determines a sequence of boom section movements based on said boom extension table and said input control signal which optimizes at least one of load capacity and stability of said crane including said telescopic boom.

3. The method of claim 2, further comprising:

(e) sensing a load being luffed;

(f) sensing a length of said telescopic boom;

(g) determining an unsafe operating condition of said telescopic boom based on said sensed load and said sensed length; and (h) prohibiting further unsafe operation of said telescopic boom when said unsafe operating condition is determined.

4. The method of claim 3, wherein said unsafe operating condition is one of exceeding a safe work load of said telescopic boom at said sensed telescopic boom length, and instability of said crane at said sensed telescopic boom length.

5. The method of claim 1, further comprising:

(e) sensing a length of said telescopic boom;

(f) sensing a length of a first boom section;

(g) determining whether movement of said boom sections has deviated from said sequence of boom section movements by more than a predetermined amount based on output from said steps (e) and (f); and (h) prohibiting further movement of said boom sections when said movement of said boom sections has deviated from said sequence of boom section movements by more than said predetermined amount.

6. The method of claim 1, wherein said step (a) stores at least a first and second boom extension table corresponding to a first and second mode of extension, respectively.

7. The method of claim 6, wherein in said first mode of extension a first boom section remains retracted and in said second mode of extension said first boom section extends and retracts.

8. The method of claim 6, further comprising:

(e) receiving input from an operator to switch extension modes; and (f) allowing manual control of said telescopic boom when said mode switch input means receives input from an operator to switch extension modes.

9. The method of claim 8, further comprising:

(f) manually controlling movement of at least one boom section to obtain a length of said telescopic boom such that said section lengths stored in said first extension table corresponding to said length of said telescopic boom equal said section lengths stored in said second extension table corresponding to said length of said telescopic boom.

10. The method of claim 9, further comprising, prior to said step (f), the step of:

(g) relieving any load on said telescopic boom.

11. The method of claim 8, further comprising:

(g) selecting one of said first and second modes according to operator input; and wherein said step (c) determines said sequence of boom section movements based on one of said first and second extension tables corresponding to said selected mode.

12. The method of claim 6, further comprising:

(g) selecting one of said first and second modes according to operator input; and wherein said step (c) determines said sequence of boom section movements based on said extension table corresponding to said selected mode.

13. A telescopic boom control system for controlling a telescopic boom having at least three boom sections, comprising:

memory means for storing at least one boom extension table, said boom extension table including a plurality of telescopic boom lengths and, for each telescopic boom length, a section length corresponding to each boom section;

input means for inputting one of retraction and extension control signals from an operator;

processing means for determining a sequence of boom section movements based on said boom extension table and said input control signal; and control means for controlling movement of said boom sections in accordance with said sequence of boom section movements.

14. The control system of claim 13, wherein said memory means stores section lengths corresponding to each of said telescopic boom lengths which optimize at least one of load capacity and stability of a crane including said telescopic boom; and said processing means determines a sequence of boom section movements based on said boom extension table and said input control signal which optimizes at least one of load capacity and stability of said crane including said telescopic boom.

15. The control system of claim 14, further comprising:

load sensing means for sensing a load being luffed;

length sensing means for sensing a length of said telescopic boom; and wherein said processing means determines an unsafe operating condition of said telescopic boom based on said sensed load and said sensed length, and prohibits further unsafe operation of said telescopic boom when said unsafe operating condition is determined.

16. The control system of claim 15, wherein said unsafe operating condition is one of exceeding a safe work load of said telescopic boom at said sensed telescopic boom length, and instability of said crane at said sensed telescopic boom length.

17. The control system of claim further comprising:

first length sensing means for sensing a length of said telescopic boom;

second length sensing means for sensing a length of a first boom section; and wherein said processing means determines whether movement of said boom sections has deviated from said sequence of boom section movements by more than a predetermined amount based on output from said first and second length sensing means, and prohibits further movement of said boom sections when said movement of said boom sections has deviated from said sequence of boom section movements by more than said predetermined amount.

18. The control system of claim 13, wherein said memory means stores at least a first and second boom extension table corresponding to a first and second mode of extension, respectively.

19. The control system of claim 18, wherein in said first mode of extension a first boom section remains retracted and in said second mode of extension said first boom section extends and retracts.

20. The control system of claim 18, further comprising:

mode switch input means for receiving input from an operator to switch extension modes; and wherein said processing means allows manual control of said telescopic boom when said mode switch input means receives input from an operator to switch extension modes.

21. The control system of claim 18, further comprising:

mode selecting means for selecting one of said first and second modes according to operator input; and wherein said processing means determines said sequence of boom section movements based on one of said first and second extension tables corresponding to said selected mode.

22. The control system of claim 13, further comprising:

first and second hydraulic cylinders which extend and retract first and second boom sections, respectively, of said telescopic boom; and wherein said control means controls hydraulic pressure supplied to said first and second hydraulic cylinders.

23. The control system of claim 13, wherein said telescopic boom includes at least four boom sections, and further comprising:

means for synchronously extending and retracting two outermost boom sections.

* * * * *